United States Patent [19]

Beck

[11] Patent Number: 5,056,868

[45] Date of Patent: Oct. 15, 1991

[54] CHAIR ARM REST MOUNTING BRACKET AND INSERT

[75] Inventor: Stephen Beck, Elkhart, Ind.

[73] Assignee: Global Glass Inc., Elkhart, Ind.

[21] Appl. No.: 556,462

[22] Filed: Jul. 24, 1990

[51] Int. Cl.[5] ..... A47C 7/54

[52] U.S. Cl. ..... 297/417; 297/416

[58] Field of Search ..... 297/416, 417, 411, 422

[56] References Cited

U.S. PATENT DOCUMENTS

| | | | |
|---|---|---|---|
| 2,278,749 | 4/1942 | Todd . | |
| 2,337,557 | 12/1943 | Jones . | |
| 2,338,814 | 1/1944 | Jones . | |
| 2,661,227 | 12/1953 | Murphy | 297/416 X |
| 2,900,011 | 8/1959 | Casey . | |
| 3,116,093 | 12/1963 | Bosack . | |
| 3,316,018 | 4/1967 | Stith | 297/416 X |
| 3,357,740 | 12/1967 | Vaughn et al. . | |
| 3,910,632 | 10/1975 | Marechal . | |
| 4,040,665 | 8/1977 | Wallace et al. . | |
| 4,067,613 | 1/1978 | Pesiri . | |
| 4,621,864 | 11/1986 | Hill . | |
| 4,707,032 | 11/1987 | Chang . | |
| 4,848,840 | 7/1989 | Toya | 297/417 |

*Primary Examiner*—Laurie K. Cranmer

*Attorney, Agent, or Firm*—Barnes & Thornburg

[57] ABSTRACT

A deformable insert and mounting bracket for pivotally attaching an arm to a chair back frame. The deformable insert has a labyrinth path for a pin on the pivoting shaft of the arm to follow during assembly of the arm to the frame to inhibit unintentional removal of the arm during pivotal operation of the arm. Passageways of the path compressingly engage the pin to hold the arm in any position.

20 Claims, 2 Drawing Sheets

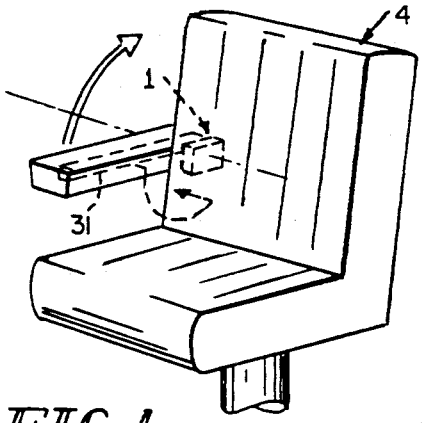
FIG. 1
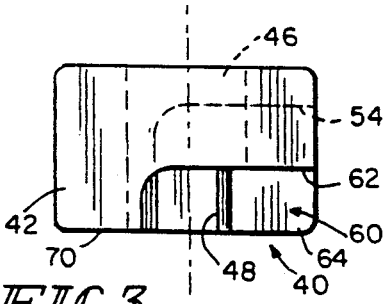
FIG. 3
FIG. 2
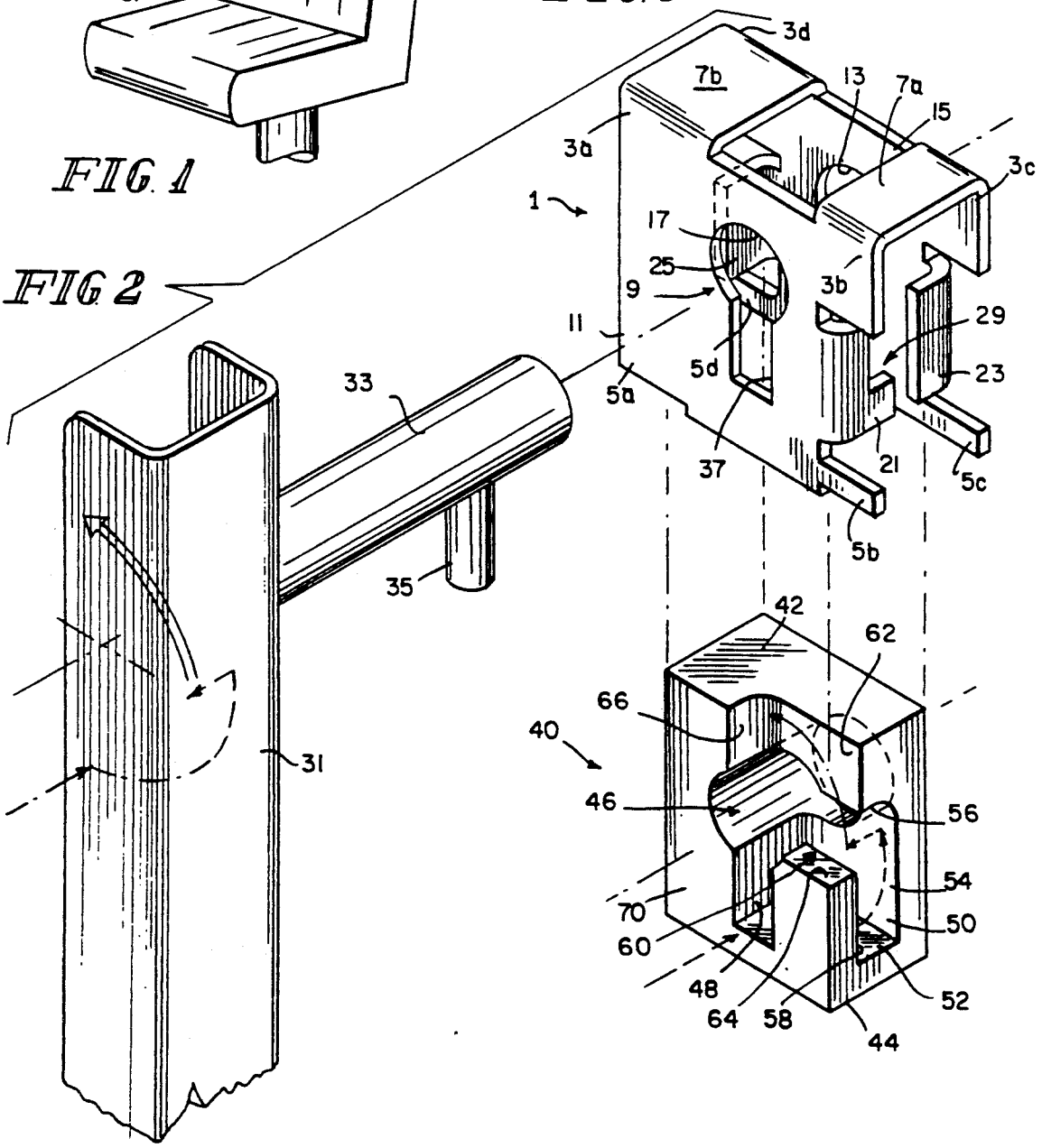

CHAIR ARM REST MOUNTING BRACKET AND INSERT

BACKGROUND AND SUMMARY OF THE INVENTION

The invention relates to a mechanism for supporting an arm rest on a chair to allow for both a pivotal movement of the arm rest with respect to a frame of a chair back and a disconnection of the arm rest from the frame of the chair back. The invention also relates to a multipurpose cushioning insert for the supporting mechanism, which holds the arm rest in any adjusted pivotal position, provides a labyrinth path for removal of the arm from the chair back, and provides noise suppression for the pivoting mechanism.

It is known to provide pivoting arms for chair backs that are attached thereto by means of a rod that provides a pivoting axis for the arm. Vaughn, et al U.S. Pat. No. 3,357,740; Chang U.S. Pat. No. 4,707,032; and Wallace, et al U.S. Pat. No. 4,040,665 each show such a rod mechanism wherein a pin on the rod passes with the rod through a keyhole opening, in a chair back frame member. Because of the keyhole opening the arm can only be inserted or withdrawn from the chair back frame in a single specific relative angular position of the pin and keyhole. That is, the pin must be aligned with the slot portion of the keyhole slot. These patents also show that the pivotal movement of the arm with respect to the chair back frame can be limited by having the pin abut a stop to limit the extent of rotation of the shaft relative to the frame of the chair back.

The above type of rod-pin and keyhole mountings suffer from the problems that such a mounting mechanism is noisy in operation, does not retain the arm in a desired set inclination, and also does not keep the arm from becoming easily disconnected from the chair back frame as it is rotated from one position to another.

It is an object of the instant invention to avoid the above problems by providing a mounting mechanism that offers a quiet operation, an ability to hold the arm at desired locations, and also provides a mechanism for inhibiting disconnection of the arm during its rotation.

These objects are obtained by providing a deformable insert and mounting bracket for pivotally attaching an arm to a chair back frame. The deformable insert has a labyrinth path for a pin on the pivoting shaft of the arm to follow during assembly of the arm to the frame to inhibit unintentional removal of the arm during pivotal operation of the arm. Passageways of the path compressingly engage the pin to hold the arm in any position.

Here an insert for the mounting bracket of the frame of the chair back. An end of the pivot shaft and the pin on the arm are axially inserted through a keyhole in one wall of the bracket and pushed into the insert which is retained in the bracket. The insert has a central bore to allow passage of the shaft completely therethrough so that the insert end of the shaft can be pushed completely through the insert and into a circular hole on an opposing wall of the bracket. This circular hole is in alignment with the circular hole of the keyhole in the bracket. The position of the pin and the shaft with respect to the insert and mounting bracket is retained inside the insert during this push insertion operation. The insert cooperates with the pin on the shaft to provide limit stops for arresting relative angular movement of the arm and the frame of the chair back during the arm's normal pivotal movement.

Other objects, advantages and novel features of the present invention will become apparent from the following detailed description of the invention when considered in conjunction with the accompanying drawings.

BRIEF DESCRIPTION OF THE DRAWINGS

FIG. 1 shows a perspective view of the chair arm, mounting bracket and seat of the invention;

FIG. 2 shows an exploded perspective view of the insert;

FIG. 3 shows a plan view of the insert;

DETAILED DESCRIPTION OF THE DRAWINGS

Figure 4:
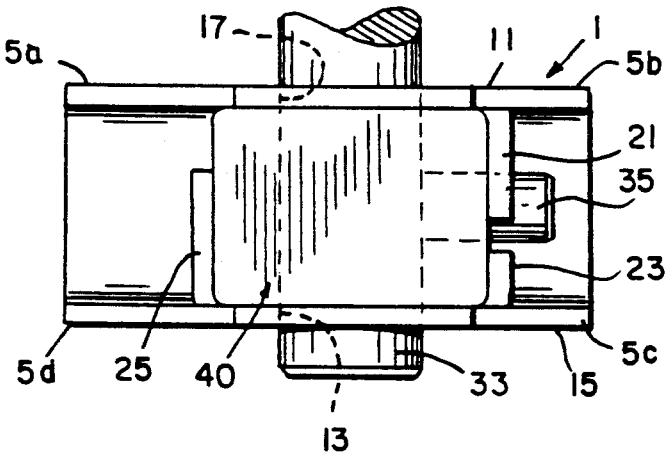
FIG. 4 shows a bottom view of the bracket with the insert and arm therein.

FIG. 1 shows a bracket 1 mounted on a chair back 4 and a chair arm 6 with an arm support 31 therein. The arm is pivotally adjusted in the direction of the arrow during use. The bracket 1 (FIG. 4) has upper 3(*a–d*) and lower 5 (*a–d*) wing extensions and top portions 7(*a–b*) for securing the bracket to a frame (not shown) of the chair back 4 as by welding, bonding, brazing, bolting, etc. A keyhole slot 9 is formed on one side wall 11 of the bracket and has its rounded portion 17 aligned with a hole 13 on the other side wall 15 of bracket 1. Insert retention tabs 21, 23 are located at one end of the bracket by bending extensions of the side walls 11 and 15 inwardly toward each other. Corresponding tab 25, is bent in from the side wall 15 at an opposite end of the keyhole 9. While three tabs 21, 23, and 25 are shown only one tab at each end is necessary. However, care should be taken to insure that the tabs do not interfere with rotation of the arm as will be explained later. To this end a cut-out 29 may be required for tab 21.

FIG. 1 shows the arm support 31 for the chair which contains a pivot shaft 33 and pin 35. Upon assembly, the shaft 33 is inserted to pass through the hole 17 of the keyhole 9 in wall 11 and aligned hole 13 in wall 15. The pin 35 can pass through stem portion 37 of keyhole 9 in wall 11 but cannot pass through wall 15 as there is no stem portion therein. To allow the bracket to have usefulness regardless of its orientation, the second hole 13 can also be a keyhole. In this manner the arm can be slid in from either side. However, for the purposes of illustration only a hole 13 is shown in wall 15.

Figure 5:
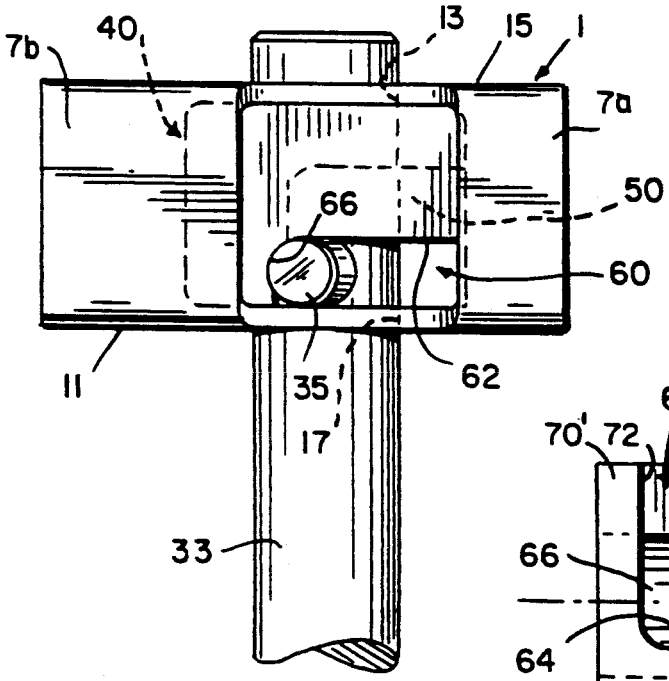
FIG. 5 shows a plan view of the bracket with the insert and arm therein.

An insert 40 for the bracket 1 is shown in detail in FIG. 2. This insert is tightly slid into the space between the walls 11 and 15 and tabs 21, 23 and 25 of the bracket 1 from the bottom of the bracket as seen in FIG. 4. Details of the insert can be found in FIG. 2 wherein 42 identifies the top of the insert and 44 the bottom. As can be seen in FIGS. 4 and 5 the insert is placed between the walls 11 and 15 from the bottom of the bracket 1 so as to have insert top 42 adjacent the top of the bracket and insert bottom 44 adjacent its point of entry and below the keyhole stem portion 37.

Referencing FIG. 2 one can see that insert 40 has a through hole 46 all the way through the insert. The hole 46 is approximately the same diameter as the shaft 33, hole 17 of keyhole 9 in wall 11 of bracket 1, and hole 13 in wall 15 of bracket 1. When the insert 40 is fully slid in between walls 11 and 15 of bracket 1, hole 46 is in registry with holes 17 and 13 in the bracket 1.

A labyrinth path is provided in insert 40 by a first elongated slot 48 which connects to a second elongated slot 50 which in turn is connected to a third elongated slot 60. The first vertical slot 48 in the insert 40 has a height extending downward from the hole 46 and equal to the length of pin 35 and a depth inwardly at least equal to twice the width of pin 35 (FIG. 2). Thus when shaft 33 is inserted into hole 17 of keyhole 9 in bracket 1, it can slide inwardly of the insert along hole 46 until pin 35 abuts wall 11 of the bracket 1. If the arm 31 is rotated to a point where pin 35 aligns itself with stem portion 37 of keyhole 9 of bracket 1, the shaft can be pushed further inwardly through bracket wall 11 into insert 40 while the pin 35 slides through first slot 48. Second vertical slot 50 in insert 40 extends perpendicular to the axis of hole 46 and downwardly from a bottom edge of the hole 46. The distance between the bottom edge 52 of the slot 50 and the bottom of the hole 46 must be equal to or must exceed the length of the pin 35 to allow for rotation of the shaft 33 as will be explained later on. The first slot 48 terminates at the rear most side wall 54 of the second slot 50. The upper end 56 of the second slot 50 extends above the center line of hole 46 by a distance at least equal to one half the thickness of pin 35 to allow the pin to become aligned with and pass through the second slot 50. When the shaft 33 and pin 35 are inserted through the bracket keyhole 9 the pin can traverse slot 48 until it abuts side wall 54 of slot 50. The shaft 33 can then be rotated counter-clockwise 90° to bring pin 35 up against upper end 56 of the second slot 50.

A third slot 60 is located in the front upper right hand corner of insert 40. It has an innermost vertical rear wall 62 that is in substantial alignment with and spaced forwardly from the front side 58 of the second slot 50 by a distance at least equal to the width of the pin 35. The third slot 60 has a horizontal bottom surface 64 which is in substantial alignment with the bottom of the hole 46. This third horizontal slot is substantially open at its top and at its, side facing end 70 of the insert which abuts against the rear of wall 11 of bracket 1 when the insert is pushed into the space between walls 11 and 15 of the bracket 1. The third horizontal slot 60 has a rear vertical stop wall 66 and a bottom stop wall 64.

In operation, after the shaft 33 and pin 35 have been Pushed all the way into hole 46 and first slot 48 and then rotated 90° to bring pin 35 to a horizontal position abutting top edge 56 of the second slot 50, the shaft 33 and pin 35 are withdrawn toward the back side of keyhole 9 in wall 11 of bracket 1 until pin 35 clears vertical back wall 62 of the third horizontal slot 62. The arm 31 is then in its assembled position.

As assembled, the arm 31 can be rotated relative to the chair back as pin 35 traverses the third slot 60. In a horizontal position of the chair arm 31, pin 35 will rest atop bottom horizontal stop wall surface 64 of the third slot which surface 64 acts as a downward limit stop for the chair arm 31. In a vertical position of the chair arm 31, pin 35 will rest against vertical rear stop wall 66 of the third slot 60 which rear stop wall 66 acts as an upward limit stop on the chair arm.

It is advantageous if the insert has at least three rectangular slots each of which have an end that extends radially and at right angles to the longitudinal axis of the hole 46 in the insert which houses the shaft 33 of the pivot mechanism for the arm of the chair. The width of these slots is the same as the width of the pin 35 to allow rotational passage of the pin through the slots. The first 48 and third slots 60 extend inwardly from a wall of the insert which abuts the backside of the keyhole slot 9 in the bracket. The first slot 48 is rectangular in cross-section with a depth at least equal to twice the width of the second 50 and third slots 60 and extends vertically. The hole 46 and the first slot 48 configuration define a keyway of a depth equal to the aforementioned twice the width of the pin and this keyway is aligned with and complementary to the keyway 9 in the bracket. The second slot 50 extends vertically, is at right angles to the keyway first slot, and is located at an inner end of the first slot. The horizontal bottom 52 of the second slot is located at the same horizontal level as the bottom of the first keyway slot. The horizontal top 56 of the second slot is located at the top of the hole 46 in the insert that receives the shaft. Thus it can be seen that the shaft 33 and associated pin 35 can be inserted through the aligned keyhole in bracket and the first slot in the insert (the shaft being accommodated in the hole of the keyhole 9 and the pin in the slot of the keyhole in the bracket and later in the hole 46 and the first slot 48 of the insert). As the shaft 33 is pushed inwardly into the insert, the pin will come to the depth end of the first slot. However, here the shaft 33 and pin 35 can be rotated 90° since the pin is then in alignment with the second slot 50. The third slot 60 is located above the first slot at the front of the insert (backside of the keyhole bracket) and has a bottom horizontal stop side 64 extending at right angles to the first keyway slot at a height equal to the bottom of the hole in the insert which receives the shaft. The third slot 60 is open upwardly from its horizontal bottom to allow for rotation of the pin 35. By having the height of the third slot at least equal to the length of the pin 35 improves gripping of the pin during arm rotation. The length of the third slot 60 extends from the hole 46 in the insert that houses the shaft 33. The depth of the third slot extends at its horizontal bottom side to the aforementioned twice the width of the pin and a bottom portion of the third slot connects with and opens into the second slot.

For ease in understanding if one utilizes clock hands for nomenclature, the cooperation of shaft and pin will be as follows. The shaft is akin to a shaft holding the hands on the clock. The stem of the keyhole 9 in the bracket 1 and the first slot 46 extend at 6 o'clock The first slot 48 is adjacent the backside of the keyhole in the bracket and with a width equal to the width of the pin and a depth twice the width of the pin. The second slot 50 extends from 6 o'clock to 3 o'clock with a width equal to the width of the pin and is spaced from the back of the keyhole in the bracket and is recessed internally of the insert. The third slot 60 extends from 3 o'clock to 12 o'clock with a width equal to the width of the pin and adjacent to the backside of the keyhole in the bracket. In assembling the arm to the frame of the chair back, the shaft is aligned with the hole 9 of the keyhole and the hole 46 inside the insert. The shaft is rotated until the pin assumes a 6 o'clock position. The shaft can then be pushed inwardly until the pin reaches the bottom of the first slot 48 (the aforementioned double width dimension) and is aligned with the second slot 50. The shaft and pin can then be rotated counter-clockwise 90° through the second slot so the pin assumes a horizontal position, abutting the horizontal top 56 of the second slot. The pin is now in alignment with the bottom of the third slot. The shaft and pin can then be pulled outwardly in a direction opposite to the initial pushed in direction until the pin reaches the back side of the bracket 1 having the keyhole 9. The shaft and pin cannot come out of the bracket when pulled outwardly since the pin is at 3 o'clock and the stem 37 of the keyhole 9 in the bracket 1 is at 6 o'clock. As the shaft and pin are pulled outwardly to the back side of the frame the pin is aligned with the third slot 60 and rests at a 3 o'clock position on the horizontal stop bottom 64 of the third slot which defines the lower pivotal position of the arm with respect to the chair back. The 12 o'clock side stop wall 66 of the third slot defines the upper stop for limiting pivoting of the arm with respect to the frame of the chair back.

It should be noted that the clock designation is for ease of explanation only. One could start out with the first slot at any clock position. Also the counter-clockwise rotation could be clockwise to align the three slots. While one usually wants 90° pivot angle for the arm in use, this would require a 3 hour sector on the clock. If more or less pivoting is desired the clock angles for the third slot would correspondingly be more or less than 3 hours. While the removal first slot 48 is set at 90° with respect to the second slot 50 there is nothing magic about this. One could have the first slot 180° (9 o'clock) if such is desired. Any angularity is possible.

While depth of the second and third slots and the width of the first slot is equal to the width of the pin so as to provide functional contact therewith, it should be recognized that their lengths will vary as the length of the pin varies.

Preferably the insert is made from a slightly compressible hard rubber or plastic composition. The widths of the three slots 48, 50 and 60 correspond to the width of pin 35 so as to tightly grasp the pin 35. For the pin 35 to traverse any of the three slots, the pin has to compress the sides of the slots to actually open them ever so slightly to allow passage of the rotating and shifting pin 35. Thus the walls of the slots are in tight compression contact with pin 35 to retard its rotational and shifting movement. This compression contact thus provides for an instantaneous brake to hold the arm in any position due to the compressive forces of the side walls grasping and wedging against the sides of the pin. This grasping and wedging also takes place in the third slot 60 where the pin is wedged against the back side of wall 11 of the bracket 1 and side surface 62 of the third slot 60.

While it is advantageous if the insert compressingly grips the pin so as to provide resistance to relative movement between the pin and insert such is not necessary. This compressive force, while providing resistance to movement, is insufficient to prevent necessary relative movement between the pin and insert, while at the same time the compressive force keeps the pin and shaft from rattling in the bracket and also acts as a sound deadener during rotation. Thus, the noise of operation of the arm is significantly reduced and for all intent and purposes eliminated.

Additionally, the aforementioned compressive contact provides resistance to relative movement between the chair arm and chair back so as to provide a mechanism to hold the arm in its adjusted position.

Ideally the material of the insert could be a rubber or plastic compound. It is advantageous if the material is also slippery or self lubricating to permit ease of rotation while still providing a compressive force. Ideally the materials should have a good elastic memory so as to have the slots return to the non-compressed cross-section after passage of the pin. Materials suitable for the insert would be nylon, "teflon", . . . etc.

Figure 6:
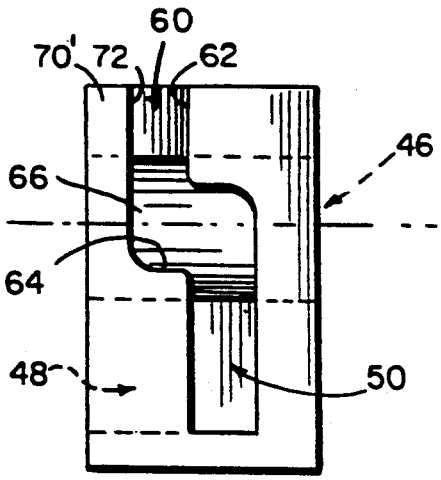
FIG. 6 shows a left side view of a modified insert block.

A variant of the above insert structure is shown in FIG. 6 wherein the third slot 60 could be recessed inwardly of the block so that a solid vertical wall 70' of the insert at third slot 60 would abut the back side of wall 11 of the bracket. One would then have the insert provided with an internal third slot 60 that has a forward side wall 72. In such a modification the pin 35 would be grasped and wedged between the two side walls 72 and 62, rather than between the rear side wall 62 and back side of wall 11 of the bracket.

Thus it can be seen that: the arm 11 will move quietly in the insert block without a chattering noise such as would be occasioned with a metal to metal mounting; the gripping and wedging action of the side walls of the three slots will apply a compressional lock for holding the arm at any adjusted position; and the arm 31 cannot be separated from the bracket unintentionally as it moves between its normal vertical to horizontal adjusting positions (with pin 35 riding in the third slot 60). The arm 31 cannot be unintentionally removed from the bracket 11, since the pin 35, as it rotates in the third slot is separated by a labyrinth from the stem portion 37 of the keyhole 9 and first slot 48. To remove an assembled arm it must be rotated to its horizontal position with pin 35 abutting lower stop wall 64 of the third slot. The arm 31 is then pushed inwardly of the insert 40 until pin 35 abuts rear side wall 54 of the second slot 50. The arm 31 can then be rotated 90° (going from a horizontal position with respect to the chair back to a vertically downward position with respect to the chair back) until the pin 35 is aligned with the first slot 48. Then the arm can be withdrawn from the insert block 40 and through the keyhole 9. The labyrinthal passage (movement inwardly of the block in the third slot 60, rotation in the second slot 50 and then outward withdrawal from the block along the first slot 48) insures that no unintentional removal of the arm is possible. This is a distinct advantage over prior art devices wherein a keyhole in the bracket would be aligned with one position in the normal use rotation of the arm.

While the disclosed embodiment has the keyhole 9 oriented vertically it could of course have any orientation. Likewise the arm support 31 and pin 35 are parallel and this too is not necessary as the pin 35 can have any orientation with respect to the arm 31. Also entrance to the third slot 60 is at 90° with respect to the first slot 48. This angle is not critical and can vary. What is important is that there be some rotation of the arm prior to being pulled outwardly from the second slot to the third slot, its working position. The third slot 60 allows for a 90° pivoting of the chair arm 31 with respect to the chair back. If more or less rotation is desirable than this, the 90° should be changed accordingly All that is necessary is that there be some angularity to bring the pin out of alignment so it can not be shifted axially in the second slot 50 or the third slot 60 as it is rotated therein. Thus some labyrinth path is desirable. The second and third slots are shown located at the right hand side of the keyhole 9 in wall 11 of the bracket when the insert is in place. These second and third slots could of course be located to the left of the keyhole slot 9. Here the pin would traverse the second conduit in a clockwise manner rather than counter-clockwise as shown. The third slot is shown in front of the second slot and overlying the first slot. It could of course be located to the rear of the second slot. Under such an arrangement one would not pull the arm outwardly of the bracket 11 to have the pin 35 engage in its use position in the third slot 60, but rather one would push the arm inwardly still further (after the pin 35 had rotated through the second slot 50) to have the pin 35 engage the third slot 60. While three slots are shown more than three slots could be utilized.

As shown, the pin 35 is rather long so as to provide a large surface area to be gripped by the side walls of the slots. In view of this an end portion of the pin 35 might extend outwardly of the block 40 when the arm is rotated to a horizontal position (note FIG. 4). Under these circumstances, the holding tabs 21, 23 may have to have cut-outs 29 to allow for passage of the end of pin 35.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An insert black for a mounting bracket that is used to pivotally attach a chair arm to a frame of a chair back where the chair arm has a pivot shaft with a pivot limit pin thereon comprising:

a generally solid insert block having at least three three-dimensional slots;

a first of the three slots being connected to and angled perpendicular to a second of the three slots; and a third of the three slots being connected to and parallel to the second of the three slots.

2. An insert according to claim 1 wherein the third slot is angled perpendicularly to the first slot.

3. An insert according to claim 2, wherein a through hole is provided through the insert block for receiving said pivot shaft; and wherein said hole has portions that are open and connect with each of said three slots.

4. An insert according to claim 1, wherein the insert block is made from a deformable material;

wherein widths of each of the three slots are not quite equal to a width of the limit pin; and wherein deformation of side walls of the slots is possible to permit passage of the limit pin through the slots.

5. An insert according to claim 1, wherein a through hole is provided through the insert block for receiving said pivot shaft; and wherein said hole has portions that are open and connect with each of said three slots.

6. An insert according to claim 1, wherein the first and second slots are located generally in a lower half of the insert block; and wherein the third slot is located generally in an upper half of the insert block.

7. An insert according to claim 6, wherein the third slot has a portion that overlies the first slot.

8. An insert according to claim 7, wherein an end wall of the first slot forms a part of a side wall of the second slot. upper half of the insert block

9. An insert according to claim 1 wherein the third slot has a portion that overlies the first slot.

10. An insert according to claim 9, wherein an end wall of the first slot forms a part of a side wall of the second slot.

11. A support mounting for pivotally coupling a chair arm to a frame of a chair back comprising:

a chair arm having a pivot shaft attached to and extending therefrom;

a limit pin attached to and extending right angles to said pivot shaft;

a bracket attached to a frame of a chair back;

wherein the bracket has a generally key-shaped opening in one wall thereof for passage of said arm and limit pin therethrough;

a pivot arm insert attached to said bracket;

an insert block having at least three slots;

a first of the three slots being connected to and angled perpendicular to a second of the three slots; and a third of the three slots being connected to and parallel to the second of the three slots;

wherein said shaft is nonrotatably slidable into said. bracket and insert block until said pin reaches said connection between the first and second slots and then said shaft being able to be rotated without sliding to a position wherein said pin is able to be nonrotatably slid through the connection between the second and third slots into the third slot and the shaft is then unable to be slid but is able to be rotated in said third slot; and wherein normal rotational adjustment of the arm relative to the frame of the chair back takes place by rotation of the shaft while the pin is in the third slot.

12. A support mounting according to claim 11, wherein the insert block has the third slot angled perpendicularly to the first slot.

13. A support mounting according to claim 12, wherein the insert block is made from a deformable material;

wherein widths of each of the three slots are not quite equal to a width of the limit pin; and wherein deformation of side walls of the slots is possible to permit passage of the limit pin through the slots.

14. A support mounting according to claim 12, wherein a straight hole is provided through the insert block; and wherein said hole has portions that are open and connect with each of said three slots.

15. A support mounting according to claim 12, wherein the first and second slots are located generally in a lower half of the insert block; and wherein the third slot is located generally in an upper half of the insert block

16. A support mounting according to claim 15, wherein the third slot has a portion that overlies the first slot; and wherein an end wall of the first slot forms a part of a side wall of the second slot.

17. A support mounting according to claim 11, wherein the insert block is made from a deformable material;

wherein widths of each of the three slots are not quite equal to a width of the limit pin; and wherein deformation of side walls of the slots is possible to permit passage of the limit pin through the slots.

18. A support mounting according to claim 11, wherein a straight hole is provided through the insert block; and wherein said hole has portions that are open and connect with each of said three slots.

19. A support mounting according to claim 11, wherein the first and second slots are located generally in a lower half of the insert block; and wherein the third slot is located generally in an upper half of the insert block.

20. A support mounting according to claim 19, wherein the third slot has a portion that overlies the first slot; and wherein an end wall of the first slot forms a part of a side wall of the second slot.

* * * * *

UNITED STATES PATENT AND TRADEMARK OFFICE

CERTIFICATE OF CORRECTION

PATENT NO. : 5,056,868

DATED : October 15, 1991

INVENTOR(S) : Stephen Beck

It is certified that error appears in the above-identified patent and that said Letters Patent is hereby corrected as shown below:

In the Detailed Description of the Drawings, column 6, line 57, please insert -- . -- after "accordingly".

In the Claims, claim 1, at column 7, line 23, please delete "black" and insert -- block -- therefor.

In the Claims, claim 8, at column 7, line 61, please delete "upper half of the insert block".

Signed and Sealed this

Seventh Day of December, 1993

*Attest:*

*Attesting Officer*

Bruce Lehman

BRUCE LEHMAN

*Commissioner of Patents and Trademarks*